US009466415B2

(12) United States Patent
Nobusaka et al.

(10) Patent No.: US 9,466,415 B2
(45) Date of Patent: Oct. 11, 2016

(54) REACTOR PROVIDED WITH A COOLER

(71) Applicants: Mao Nobusaka, Obu (JP); Takashi Atsumi, Toyota (JP)

(72) Inventors: Mao Nobusaka, Obu (JP); Takashi Atsumi, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 14/760,385

(22) PCT Filed: Jan. 13, 2014

(86) PCT No.: PCT/IB2014/000154

§ 371 (c)(1),
(2) Date: Jul. 10, 2015

(87) PCT Pub. No.: WO2014/111809

PCT Pub. Date: Jul. 24, 2014

(65) Prior Publication Data

US 2015/0357109 A1 Dec. 10, 2015

(30) Foreign Application Priority Data

Jan. 15, 2013 (JP) ..... 2013-004394

(51) Int. Cl.

| | |
|---|---|
| ***H01F 27/08*** | (2006.01) |
| ***H01F 27/10*** | (2006.01) |
| ***H01F 27/255*** | (2006.01) |
| ***H01F 27/26*** | (2006.01) |
| ***H01F 27/28*** | (2006.01) |
| ***H01F 27/02*** | (2006.01) |

(Continued)

(52) U.S. Cl.

CPC ..... *H01F 27/10* (2013.01); *H01F 27/02* (2013.01); *H01F 27/06* (2013.01); *H01F 27/08* (2013.01); *H01F 27/16* (2013.01); *H01F 27/22* (2013.01); *H01F 27/255* (2013.01); *H01F 27/263* (2013.01); *H01F 27/288* (2013.01); *H01F 27/2823* (2013.01); *H01F 37/00* (2013.01)

(58) Field of Classification Search

CPC ..... H01F 27/00–27/30
USPC ..... 336/55–62, 220–223, 233–234
See application file for complete search history.

(56) References Cited

U.S. PATENT DOCUMENTS

| | | | |
|---|---|---|---|
| 2001/0024739 | A1 | 9/2001 | Mizoguchi et al. |
| 2005/0012581 | A1 | 1/2005 | Ono et al. |

(Continued)

FOREIGN PATENT DOCUMENTS

| | | | |
|---|---|---|---|
| JP | 2001-244123 | A | 9/2001 |
| JP | 2005-045960 | A | 2/2005 |

(Continued)

OTHER PUBLICATIONS

EP Office Action issued Apr. 6, 2016 in EP 14 710 629.8.

*Primary Examiner* — Tuyen Nguyen
(74) *Attorney, Agent, or Firm* — Sughrue Mion, PLLC

(57) ABSTRACT

A reactor provided with a cooler, comprising: a coil, a core formed of a soft magnetic material, the core covers an inside of the coil and an outer periphery of the coil; the cooler being arranged on both sides of the core, the core and the cooler being pressed in a stacking direction of the core and the cooler; a thickness of the core in the stacking direction being smaller than a length of a height of a surface of the core that faces the stacking direction; and the thickness of the core in the stacking direction being smaller than a length of a width of the surface of the core that faces the stacking direction.

6 Claims, 7 Drawing Sheets

(51) Int. Cl.

| | |
|---|---|
| ***H01F 27/06*** | (2006.01) |
| ***H01F 27/16*** | (2006.01) |
| ***H01F 27/22*** | (2006.01) |
| ***H01F 37/00*** | (2006.01) |

(56) References Cited

U.S. PATENT DOCUMENTS

| | | | | |
|---|---|---|---|---|
| 2007/0295715 | A1 | 12/2007 | Saka et al. | |
| 2009/0002110 | A1* | 1/2009 | Ahangar | H01F 27/10 336/60 |
| 2012/0105190 | A1 | 5/2012 | Mitani et al. | |
| 2013/0127579 | A1 | 5/2013 | Ueno et al. | |
| 2014/0320249 | A1* | 10/2014 | Nobusaka | H01F 27/02 336/90 |

FOREIGN PATENT DOCUMENTS

| | | | |
|---|---|---|---|
| JP | 2006-004957 | A | 1/2006 |
| JP | 2007-335833 | A | 12/2007 |
| JP | 2008161005 | A | 7/2008 |
| JP | 2008-198981 | A | 8/2008 |
| JP | 2011-082489 | A | 4/2011 |
| JP | 2011-238699 | A | 11/2011 |
| JP | 2012-235051 | A | 11/2012 |
| WO | 2011/101976 | A1 | 8/2011 |
| WO | 2013/001592 | A1 | 1/2013 |

* cited by examiner

REACTOR PROVIDED WITH A COOLER

BACKGROUND OF THE INVENTION

1. Field of the Invention

The invention relates to a reactor provided with a cooler. The reactor is a passive element that uses a coil, and may also be referred to as an "inductor".

2. Description of Related Art

Electric vehicles including hybrid vehicles are equipped with a power converter that converts output power of a battery to power suitable for driving a running motor. The power converter may include not only an inverter circuit that converts direct current into alternating current, but also a voltage converter circuit. A power converter for an electric vehicle handles large current, so devices with a large allowable current are also employed for the devices used for the inverter circuit and the voltage converter circuit.

A device with a large allowable current generates a large amount of heat. One device that generates a particularly large amount of heat is a reactor that is included in a voltage converter circuit. Therefore, technology to efficiency cool the reactor is necessary. For example, Japanese Patent Application Publication No. 2008-198981 (JP 2008-198981A) and Japanese Patent Application Publication No. 2005-045960 (JP 2005-045960A) propose structures in which a reactor is tucked into a cooler. In particular, JP 2008-198981 A describes a structure in which a reactor and a semiconductor module that includes a switching element are alternately sandwiched by a plurality of flat plate-shaped coolers.

Regarding the reactor, technology described in Japanese Patent Application Publication No. 2001-244123 (JP 2001-244123A) and Japanese Patent Application Publication No. 2011-082489 (JP 2011-082489A) is known. JP 2001-244123 A describes a reactor suitable to be surface-mounted. JP 2011-082489 A describes a reactor that uses a coil wound flatwise. A "coil wound flatwise" refers to a coil in which a flat wire is wound such that a flat surface overlaps with itself in a radial direction of a coil axis. The coil axis may also be referred to as a winding axis.

SUMMARY OF THE INVENTION

The present invention provides a reactor provided with a cooler, which offers a better cooling effect.

The reactor provided with a cooler in accordance with a one aspect of the present invention, comprising: a coil; a core formed of a soft magnetic material, the core covers an inside of the coil and an outer periphery of the coil; the cooler being arranged on both sides of the core, the core and the cooler being pressed in a stacking direction of the core and the cooler; a thickness of the core in the stacking direction being smaller than a length of a height of a surface of the core that faces the stacking direction, and the thickness of the core in the stacking direction being smaller than a length of a width of the surface of the core that faces the stacking direction. With the reactor described in this aspect, the core is a flat body in which a thickness in the stacking direction is smaller than a length of a height of a surface of the core that faces the stacking direction, and is smaller than a length of a width of the surface facing the stacking direction described above. By making the thickness of the core in the stacking direction thin as described above, heat from the center portion of the coil is quickly transferred to the adjacent cooler on both sides. A stacked body of the core and the cooler are pressed in a stacking direction. Pressing in the stacking direction brings the core and the cooler into closer contact, and thereby increases the heat transfer efficiency from the core to the cooler.

Also, using a core that covers the inside and the outer periphery of the coil enables large inductance to be ensured, compared with a reactor having a core arranged only on the inside of the coil. This is because magnetic flux also passes on the outer periphery of the core. This kind of a core may be manufactured by hardening soft magnetic particles (or powder). This kind of a core is may typically be made by injection molding resin that includes soft magnetic particles.

In order to both achieve large inductance and have the reactor be thin, in another aspect of the reactor described in the specification, a plurality of coil portions that are connected together in series may be employed. And, the plurality of coil portions being arranged lined up in a direction intersecting the stacking direction in the core may be employed. A plurality of coil portions that are connected together in series increases the inductance. Meanwhile, having the plurality of coil portions be arranged in a line helps to make thickness of the core thin. The reactor described in this specification is not limited to having two coil portions. The number of coil portions may also be three or more.

Also, when the thickness in the stacking direction is reduced, a core surface area that contacts the cooler increases. This helps to both improve the cooling efficiency, and increase the load that the stacked body of the reactor (i.e., the core) and the cooler is able to withstand. Applying a large load from both sides of the stacked body makes it possible to firmly retain the reactor in the stacked body. For example, the reactor can be retained between coolers by just the load, without using a bolt or a screw.

In order to both achieve large inductance and have the reactor be thin, in another aspect of the reactor described in the specification, the coil is formed by winding a flat wire flatwise (i.e., a coil in which a flat wire is wound flatwise) may be employed, and this kind of coil may be arranged such that a coil axis points in the stacking direction. In other words, the coil may be arranged such that the coil axis is aligned with the stacking direction of the reactor and the cooler. Hereinafter, a coil in which a flat wire is wound flatwise will be referred to as a "flatwise coil". A flatwise coil is a thin coil in which a winding does not overlap with itself in the coil axial direction, and in which large current is able to be allowed by using the flat wire. In addition, when the coil is arranged such that the coil axis points in the stacking direction, an end surface of the coil (i.e., an end surface in the coil axial direction) opposes the cooler, so the efficiency with which heat is transferred from the coil to the cooler further improves.

On the other hand, if the coil and the cooler are too close together, magnetic flux that leaks to the cooler increases. Therefore, a magnetic shielding plate may be arranged between the coil and the cooler. The magnetic shielding plate may be embedded in the core, or it may be inserted between the reactor and the cooler.

When two flatwise coil portions are employed, a connecting portion may configured to connect an end portion inside of one of the coil portions and an end portion inside of another of the coil portions, and the connecting portion may be arranged opposing the cooler. Heat transfer from the coil portions to the connecting portion, and from connecting portions to the cooler, is able to be promoted. As described above, the reactor may also include three or more coils.

The specification also describes an improvement to further improve the heat dissipation efficiency of the coil in the reactor provided with a cooler described above. Below, several structures that improve the heat dissipation effect of the coil will be described. In one aspect, a metal frame that surrounds a side surface of the core that faces in a direction intersecting with the stacking direction may be employed, and the metal frame may be contacting the cooler. The metal frame promotes the dissipation of heat from the core to the cooler.

Also, in another aspect, the reactor may include a metal column that passes through the core inside the coil in the coil axial direction, and an end surface of the metal column may be contacting the cooler. Heat inside the coil is transferred to the cooler through the metal column.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
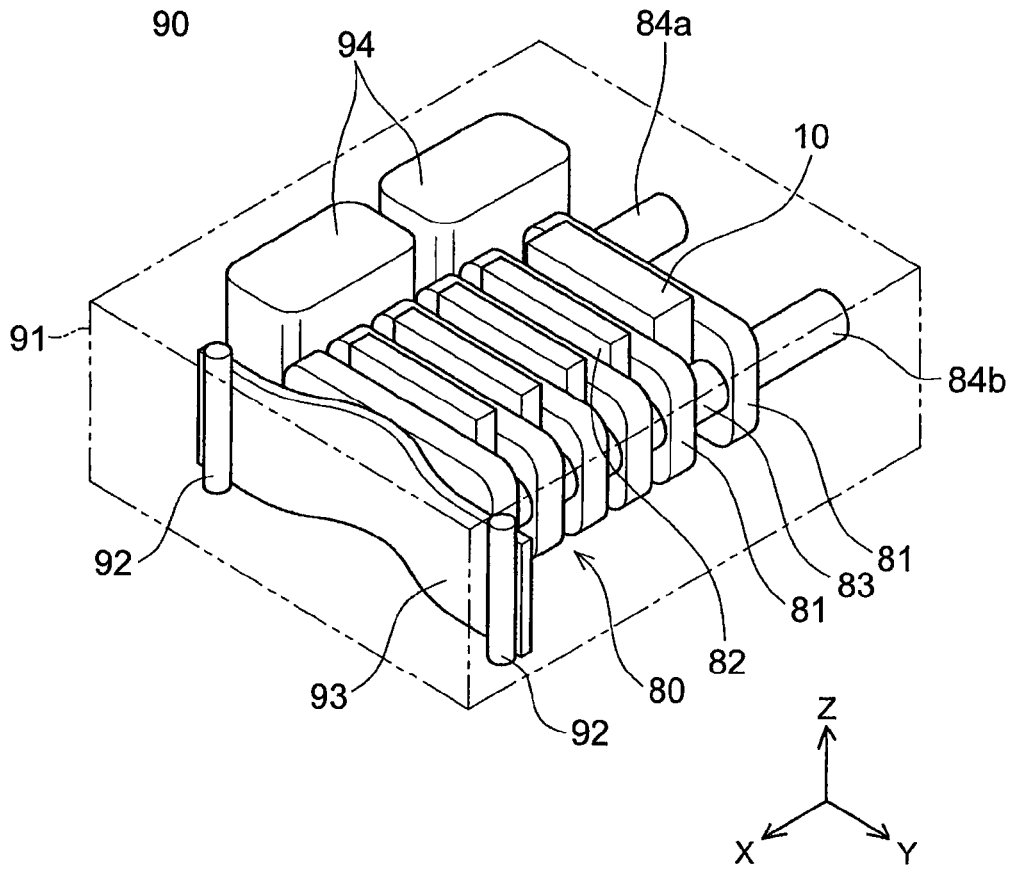
FIG. 1 is a perspective view of a power converter including a stacked unit of a reactor, a semiconductor module, and a cooler.

Embodiments in accordance with the present invention will be described hereinafter in detail with reference to the attached drawings. First, a power converter to which the reactor is applied will be described. FIG. 1 is a perspective view of the power converter 90. The power converter 90 is mounted in a hybrid vehicle or an electric vehicle. The power converter 90 steps up direct current (DC) power from the battery, and converts the DC power into alternating current of a frequency suitable for driving an induction motor or a PM motor. That is, the power converter 90 includes a step up converter circuit or an inverter circuit. As is well known, both of these circuits use many so-called power semiconductor elements. A plurality of power semiconductor elements is placed on a plurality of flat plate-shaped semiconductor modules 82. With each semiconductor module 82, one or a plurality of power semiconductor elements are molded with resin. In FIG. 1, terminals that extend from the semiconductor modules 82 are not shown. The power semiconductor elements generate a large amount of heat. Therefore, in the power converter 90, the plurality of flat plate-shaped semiconductor modules 82 are stacked alternately with a plurality of flat plate-shaped coolers 81. A stacked body of a plurality of semiconductor modules 82 and a plurality of coolers 81 will be referred to as a stacked unit 80. A reactor 10 is also stacked, in addition to the semiconductor modules 82, in the stacked unit 80. That is, the reactor 10 is sandwiched on both sides by the coolers 81. The reactor 10 is one component of a step up converter. The circuit of the step up converter is well known, so a description of it will be omitted. The reactor 10 and the coolers 81 on both sides thereof form a "reactor provided with a cooler".

With the stacked unit 80, adjacent coolers 81 are connected to a connecting pipe 83. Also, a coolant supply pipe 84*a* and a coolant discharge pipe 84*b* are connected to the cooler 81 on one end of the stacked unit 80. Also, the coolers 81 are flow paths through which coolant flows. The coolant supplied from the coolant supply pipe 84*a* spreads to all of the coolers 81 through the connecting pipe 83. The coolant cools the adjacent semiconductor modules 82 or reactor 10 through which the flow path of the coolers 81 passes. Coolant that has adsorbed heat from the semiconductor modules 82 or the reactor 10 is discharged outside through a separate connecting pipe 83 and the coolant discharge pipe 84*b*.

In order to increase the cooling efficiency, the stacked unit 80 is pressed on in the stacking direction thereof. The stacked unit 80 is housed in a case 91. One end of the stacked unit 80 is pressed against an inside wall of the case 91, and a plate spring 93 is inserted on the other end side. The plate spring 93 is supported by supports 92 of the case 91. The stacked unit 80 is pressed on in the stacking direction by the plate spring 93 inside the case of the power converter 90. As a result of the stacked unit 80 being pressed on in the stacking direction, the degree of contact between the semiconductor modules 82 and the coolers 81, and between the reactor 10 and the coolers 81 increases, so the efficiency with which heat is transferred to the coolers 81 improves.

Also, the power converter 90 includes a large capacity capacitor 94 for smoothing the output current of the battery and output current of the step up converter circuit. The capacitor 94 is housed, together with the stacked unit 80, in the case 91. In addition to the devices described above, the power converter 90 also includes a control board that controls the step up converter circuit and the inverter circuit, but in FIG. 1, the control board and a cover of the case are not shown.

First Embodiment

Figure 2:
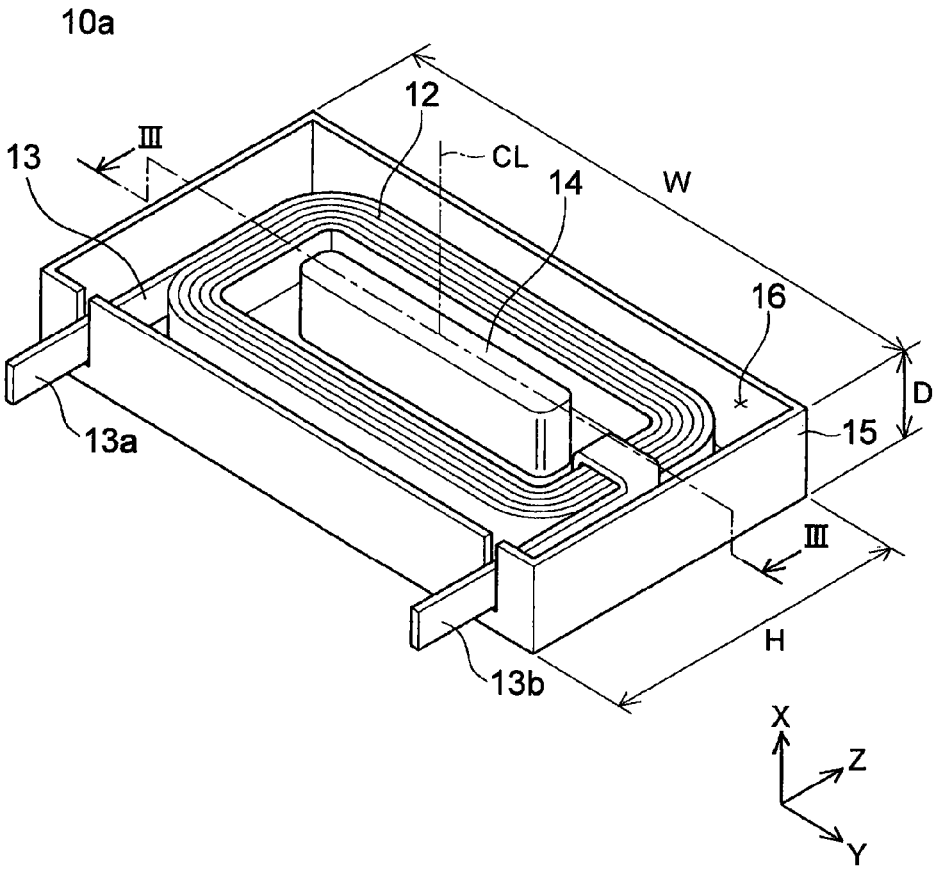
FIG. 2 is a perspective view of a reactor according to a first embodiment of the present invention.

Next, a first embodiment of the reactor 10 described above will be described. FIG. 2 is a perspective view of a reactor 10*a* according to the first embodiment of the present invention. The main component of the reactor 10*a* is a coil 12 of wound flat wire 13. An inside and outer periphery of the coil 12 are molded with resin that includes soft magnetic particles, but in FIG. 1, the resin mold is not shown in order to shown the shape of the coil. In FIG. 2, resin (i.e., resin that includes soft magnetic particles) is filled into a space denoted by reference character 16. This resin mold corresponds to a core of the reactor. Therefore, for the sake of simplicity, the core 16 will be represented by the reference character 16 that indicates the space. In other words, the core 16 is formed of hardened soft magnetic particles. Also, a magnetic shielding plate is arranged on both sides of the coil 12 in the coil axial direction, but is not shown in the drawings. The magnetic shielding plate will be described later with reference to FIG. 3. A straight line. CL in the drawings represents a coil axis (winding axis).

The overall shape of the reactor 10*a* is generally rectangular parallelepiped, and the size thereof has a height H, a width W, and a thickness D. The relationship among these dimensions is width W>height H>thickness D. As can be understood when comparing the coordinate systems in FIGS. 1 and 2, the X direction of the coordinate axes corresponds to the stacking direction of the reactor 10 and the coolers 81. Therefore, the reactor 10*a* is a flat body in which the thickness D in the stacking direction is smaller than a length W of the width and a length H of the height of a surface facing the stacking direction. This flat body of the reactor 10*a* ensures a wide contact area with the coolers. Therefore, the efficiency with which heat is transferred to the coolers 81 that are arranged on both sides is good.

A main body of the reactor 10*a* is the coil 12 in which the flat wire 13 is wound flatwise. As described above, the coil 12 is covered on the inside and outside by the core 16. This core 16 is surrounded by a metal frame 15. Lead lines 13*a* and 13*b* extend from the coil 12. These lead lines 13*a* and 13*b* extend to outside the reactor from slits provided in the metal frame 15. The lead lines 13*a* and 13*b* correspond to terminals of the reactor 10*a*.

Figure 3:
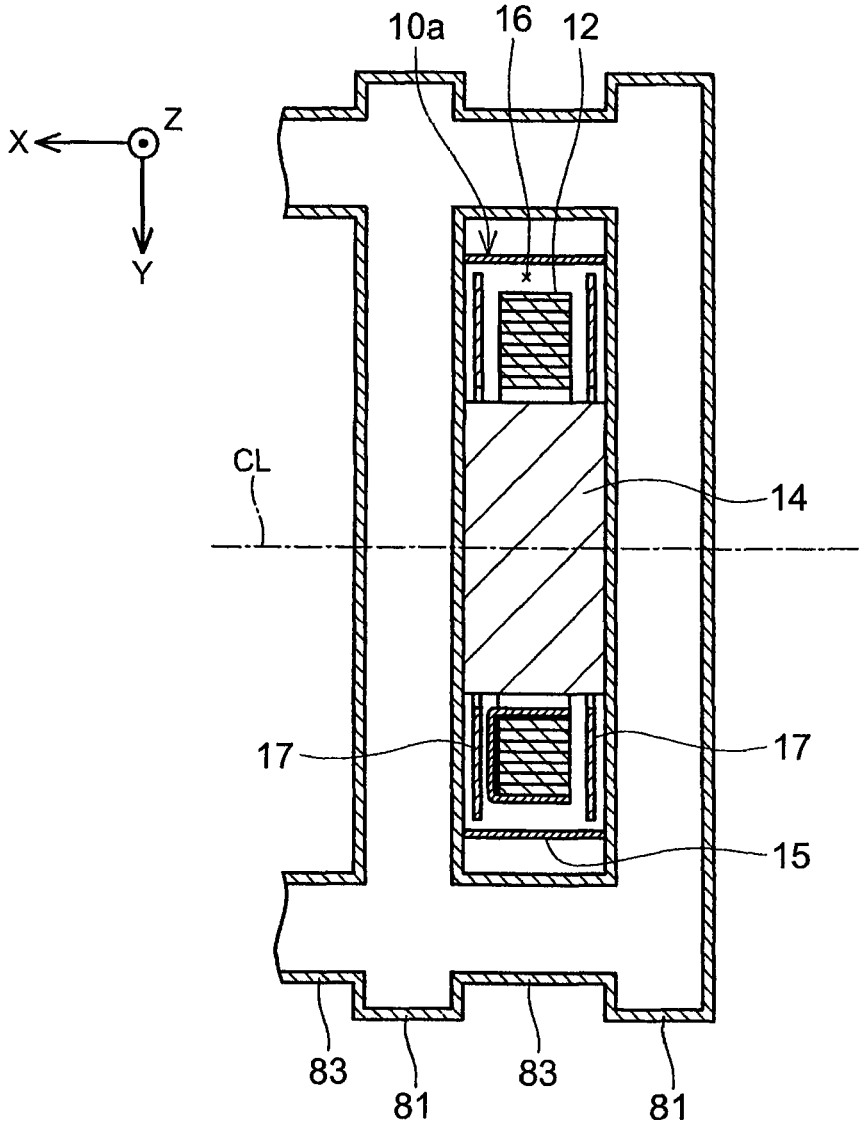
FIG. 3 is a sectional view of the reactor taken along line III-III in FIG. 2.

FIG. 3 is a sectional view taken along line III-III of FIG. 2. In FIG. 3, magnetism shielding plates 17, not shown in FIG. 2, are shown. Also, in FIG. 3 as well, similar to FIG. 2, hatching indicating the cross-section of the core 16 is omitted to make the drawing easier to see. The space indicated by the reference character 16 is ordinarily filled with soft magnetic particles of the core 16. As is well indicated in FIG. 3, the reactor 10*a* closely contacts the coolers 81 on both sides.

As is well shown in FIG. 3, the coil 12 is arranged such that the axis CL thereof points in the stacking direction (i.e., the X axis direction in the drawing) of the reactor 10*a* and the coolers 81. Also, the coil 12 is arranged such that end surfaces thereof oppose the coolers 81. This kind of arrangement enables the surface area of the coil opposing the coolers 81 to be increased, which also helps to improve cooling efficiency.

Inside of the coil, a metal column 14 passes through the coil 12 in the direction of the coil axis CL. Also, as described above, the core 16 is surrounded by the metal frame 15. Further, the metal frame 15 and the metal column 14 are both contacting the core 16, and also both contacting the coolers 81 on both sides. The metal frame 15 and the metal column 14 are made of metal having high thermal conductivity, such as aluminum, which helps to transfer the heat from the coil 12 to the coolers 81 on both sides. In particular, heat from inside the coil is transferred well to the coolers 81.

As is well shown in FIG. 3, the core 16 covers the area around the coil 12. The core 16 also covers the outer periphery of the coil 12, so magnetic flux passes through the core 16 both on the inside and outside of the coil. A magnetic field generated by current flowing through the coil 12 passes through the core 16 in a concentrated manner. The reactor 10*a* is advantageous in that the core 16 covers the entire coil 12, so leakage flux is low.

Also, the magnetic shielding plates 17 are embedded in the core 16. The magnetic shielding plates 17 are inserted between the coil 12 and the coolers 81. The magnetic shielding plates 17 reduce the amount of magnetic flux that leaks to the coolers 81. The magnetic shielding plates 17 are particularly useful when the coil axis CL is pointing in the stacking direction. This is because magnetic flux spreads from inside the coil to outside the coil in the coil axial direction.

The reactor 10*a* of the first embodiment includes the flatwise coil (i.e., the coil 12). End surfaces of this coil 12 oppose the coolers 81 positioned on both sides. With this kind of structure, heat from the coil 12 is efficiently transferred to the coolers 81. Also, the metal frame 15 surrounding the core 16 and the metal column 14 that passes through the core 16 inside the coil also helps to efficiently transfer heat from the coil to the coolers 81.

Second Embodiment

Figure 4:
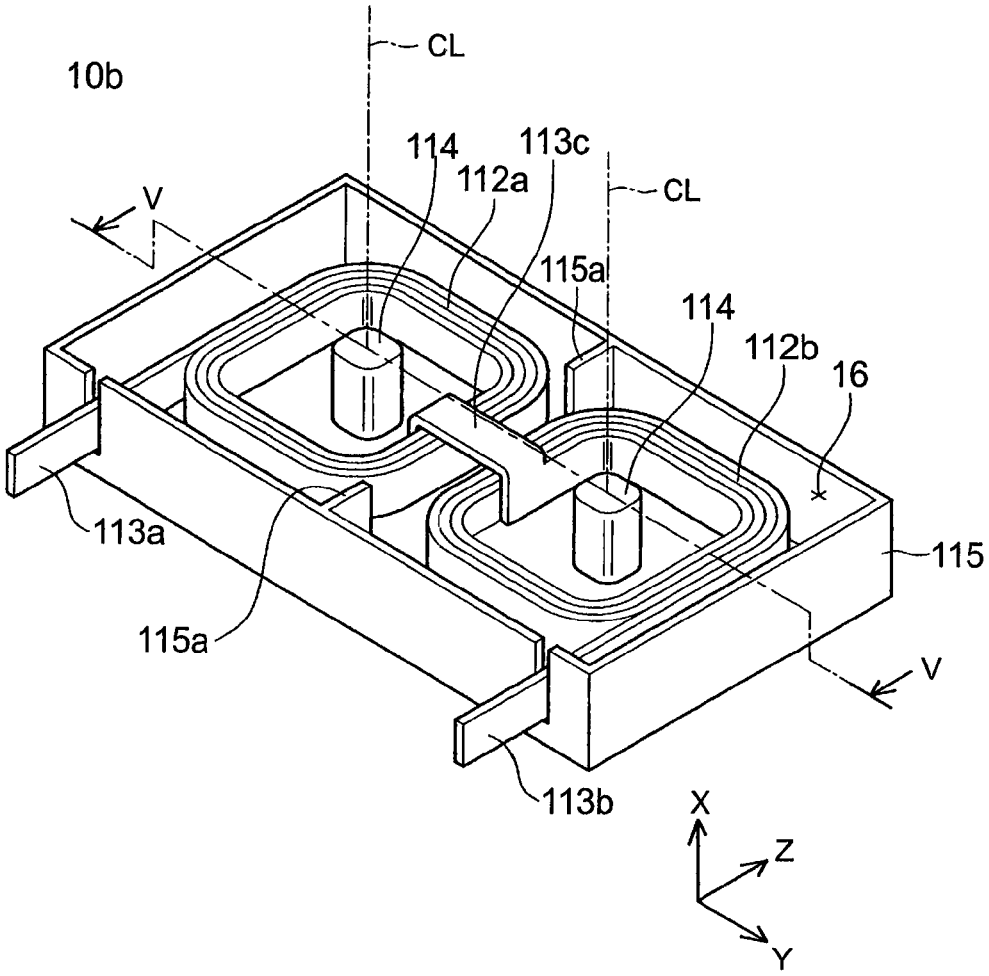
FIG. 4 is a sectional view of a reactor according to a second embodiment of the present invention.
Figure 5:
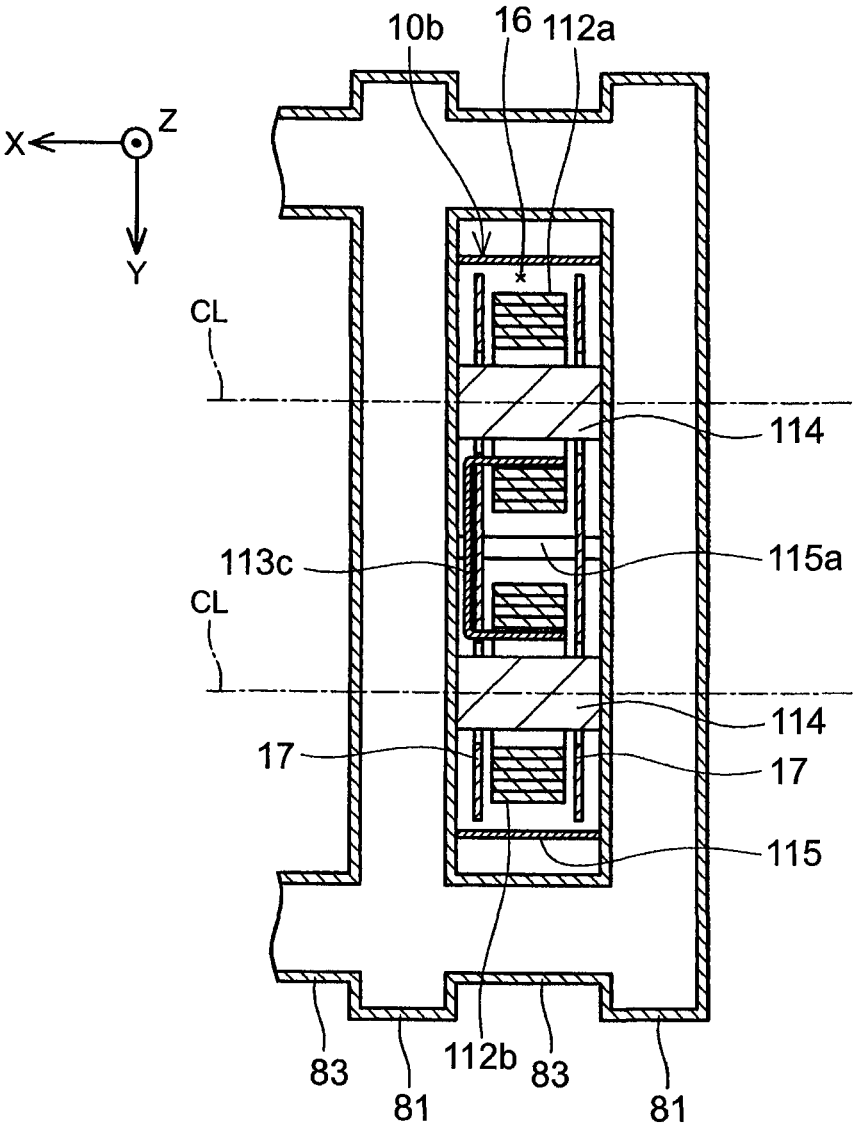
FIG. 5 is a sectional view of the reactor taken along line V-V in FIG. 4.

Next, a reactor 10*b* according to a second embodiment of the present invention will be described. FIG. 4 is a perspective view of the reactor 10*b*. FIG. 5 is a sectional view taken along line V-V in FIG. 4. The reactor 10*b* is the same size as the reactor 10*a* in the first embodiment. The reactor 10*b* is also a flat body in which the thickness in the stacking direction is smaller than the length of the height and the length of the width of a surface facing the stacking direction. In FIGS. 4 and 5 as well, similar to FIGS. 2 and 3, the core is not shown, but the space denoted by reference character 16 corresponds to the core 16. Hereinafter as well, for the sake of simplicity, the space denoted by reference character 16 will represent the core 16.

The reactor 10*b* includes two consecutive coil portions 112*a* and 112*b* that are connected together in series. Each of these coil portions is a flatwise coil. The two consecutive coil portions 112*a*, 112*b* are arranged lined up in a direction (YZ in-plane direction in the drawing) intersecting the stacking direction, with coil end surfaces opposing the coolers 81. Arranging two consecutive coil portions lined up side-by-side increases coil performance (i.e., inductance) without increasing the thickness of the reactor.

Also, the two coil portions 112*a* and 112*b* that are wound flatwise are electrically connected together at end portions inside of the coils, so a flat wire 113*c* of the connecting portion opposes the cooler 81. As is well shown in FIG. 4, the flat wire of the coil portion 112*a* inside end portion is bent on the inside of the coil portion 112*a*, traverses the coil end surface, and extends to the other coil portion 112*b*. Also, as is well shown in FIG. 5, the flat wire 113*c* of the connecting portion is closer to the cooler 81 than the coil end surface is. A winding of the coil portions (i.e., the flat wire) is often made of copper with little electrical resistance, and copper has high thermal conductivity. Therefore, the flat wire 113*c* of the connecting portion opposes the cooler 81, and is closer to the cooler 81 than the coil end surface is, so heat inside of the coil is well transferred to the cooler 81 via the flat wire 113*c*.

Similar to the reactor 10*a*, in the reactor 10*b* as well, the core 16 is surrounded by a metal frame 115, and this metal frame 115 is contacting the coolers 81 on both sides. The metal frame 115 also helps to transfer heat from the coils to the coolers 81. Also, the metal frame 115 includes ribs 115*a* that extends inward. These ribs 115*a* help to ensuring the strength of the overall reactor 10*b*.

Further, similar to the reactor 10*a*, the reactor 10*b* also includes metal columns 114 that pass through the core 16 inside each of the coil portions 112*a* and 112*b*, and these metal columns 114 contact the coolers 81 on both sides. The metal columns 114 also help to transfer heat from the coils to the coolers 81.

As shown in FIG. 5, in the reactor 10*b* as well, the magnetic shielding plates 17 are inserted between the coil portions 112*a* and 112*b* and the coolers 81. The magnetic shielding plates 17 reduce the amount of magnetic flux that leaks to the coolers 81.

Third Embodiment

Figure 6:
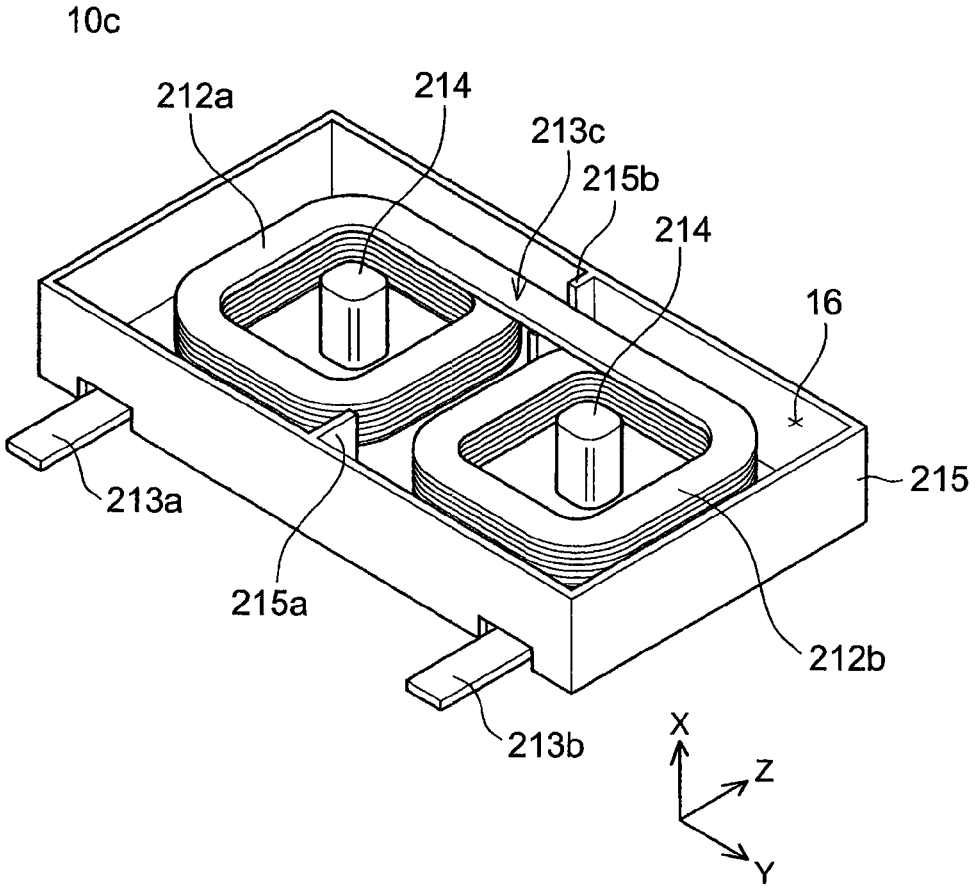
FIG. 6 is a sectional view of a reactor according to a third embodiment of the present invention.

Next, a reactor 10*c* of a third embodiment of the present invention will be described. FIG. 6 is a perspective view of the reactor 10*c*. In FIG. 6 as well, the core is not shown in order to better show the coils. In FIG. 6, the space indicated by reference character 16 is normally filled up by the core 16.

The reactor 10*c* is also the same size as the reactor 10*a* of the first embodiment. The reactor 10*c* is also a flat body in which the thickness in the stacking direction is less than the length of the height and the length of the width of a surface facing the stacking direction.

The reactor 10*c* employs an edgewise coil. Edgewise refers to winding such that a flat surface of a flat wire faces the coil axial direction, and the flat surface overlaps with itself. In other words, with an edgewise winding, the stacking direction of the flat wire follows the coil axis.

The reactor 10*c* includes two consecutive coil portions 212*a* and 212*b* that are connected together in series. Each of these coil portions 212*a*, 212*b* is an edgewise coil. The two consecutive coils 212*a*, 212*b* are arranged lined up in a direction (YZ in-plane direction in the drawing) intersecting the stacking direction of the reactor and the coolers, with coil end surfaces opposing the coolers 81. Arranging two consecutive coils lined up side-by-side increases coil performance (i.e., inductance) without increasing the thickness of the reactor.

Similar to the reactor 10*b*, the reactor 10*c* includes a metal frame 215 and metal columns 214. Also, ribs 215*a* that ensure strength are provided on the metal frame 215. A notch through which a portion 213*c* of the flat wire that connects the coil portion 212*a* to the coil portion 212*b* is provided in one of the ribs 215*b*. Although not shown, the reactor 10*c* also has magnetic shielding plates.

Fourth Embodiment

Figure 7:
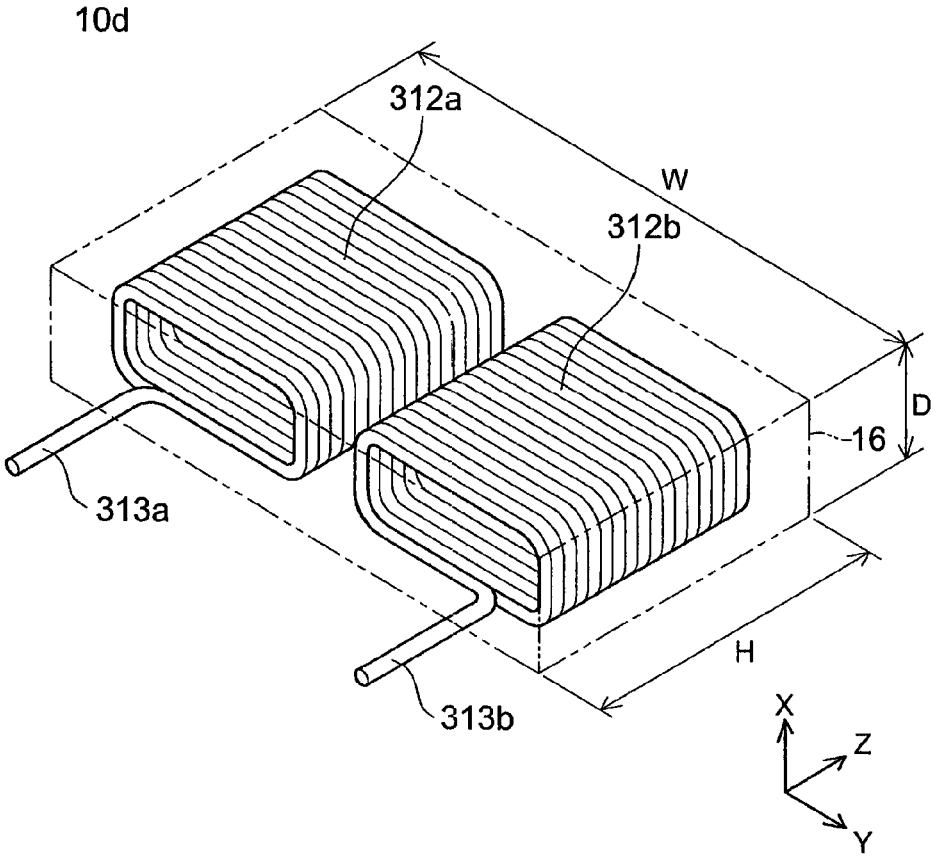
FIG. 7 is a sectional view of a reactor according to a fourth embodiment of the present invention.

Next, a reactor 10*d* of a fourth embodiment of the present invention will be described. FIG. 7 is a perspective view of the reactor 10*d*. The reactor 10*d* employs coil portions 312*a*, 312*b* that are wound wires with circular cross-sections. Reference character 16 denotes a core 16 in which the two consecutive coil portions 312*a*, 312*b* are molded with resin that includes soft magnetic particles. The reactor 10*d* is also the same size as the reactor 10*a* of the first embodiment, and is a flat body in which the thickness D in the stacking direction is smaller than the length H of the height and the length W of the width of a surface that faces the stacking direction. The reactor 10*d* does not have a metal frame. Making the core by injection molding with resin that includes soft magnetic particles is advantageous in that a case does not need to be provided separately, so the reactor is able to be manufactured at a low cost. Also, conventionally when using a core that is not injection molded, a method such as potting is employed to insulate around the core, but potting is not necessary when an injection molded core is used. The case may also be omitted with the reactors of the first to third embodiments as well.

Points to keep in mind regarding the technology described in the embodiments will now be described. With the reactor described in this specification, the core 16 is a flat body in which the thickness in the stacking direction is smaller than the length of the height and the length of the width of the surface that faces the stacking direction. When the surface of the core 16 that faces the stacking direction is oblong (elliptical), the length of the height and the length of the width correspond to the length of the long axis and the length of the short axis of the ellipse. Also, when the surface of the core that faces the stacking direction is neither an ellipse nor a rectangle, the lengths of the height and width of a rectangle that circumscribes the surface of the core that faces the stacking direction correspond to the length of the height and the length of the width described above.

The reactor 10*a* of the first embodiment is such that one coil is molded with resin (i.e., the core) that includes soft magnetic particles. In the reactors 10*b* to 10*c* of the second to fourth embodiments, two coil portions are molded with resin that includes soft magnetic particles. The number of coil portions included in a single reactor may also be three or more. Also, with the stacked unit 80 shown in FIG. 1, a plurality of the semiconductor modules 82 and one reactor 10 may be alternately stacked with the coolers 81. In a stacked unit, a plurality of reactors may also be alternately stacked with coolers, and the plurality of reactors may be connected together in series to obtain a large inductance.

The core that covers the inside and outer periphery of the coils in the embodiments is made by injection molding resin that includes soft magnetic particles. The core may also not include resin, or may be hardened with only soft magnetic particles.

Heretofore, the present invention have been described in detail, but these are merely examples, and the invention is not limited to these examples. The invention also includes various modifications of the embodiments described above. Also, the technical elements illustrated in the specification and the drawings display technical utility both alone and in various combinations. Further, the technology illustrated in the specification and the drawings simultaneously achieves a plurality of objects, and has technical utility by simply achieving one of these objects.

The invention claimed is:

1. A reactor provided with a cooler, comprising:

a coil including a plurality of coil portions, the coil portions formed by winding a flat wire flatwise, the coil portions connected together in series with a connection portion, the connecting portion configured to connect an end portion inside of one of the coil portions and an end portion inside of another of the coil portions, the connecting portion being the flat wire;

a core formed of a soft magnetic material, an inside of the coil and an outer periphery of the coil being covered by the core;

the cooler being arranged on both sides of the core, the core and the cooler being pressed in a stacking direction of the core and the cooler, wherein the coil portions are arranged such that a coil axis points in the stacking direction, the coil portions are arranged lined up in a direction intersecting the stacking direction, a thickness of the core in the stacking direction is smaller than a length of a height of a surface of the core that faces the stacking direction, the thickness of the core in the stacking direction is smaller than a length of a width of the surface of the core that faces the stacking direction, and the connecting portion is arranged opposing the cooler.

2. The reactor according to claim 1, wherein an end surface of each of the coil portions being arranged opposing the cooler.

3. The reactor according to claim 1, further comprising:

a metal frame that surrounds a side surface of the core that faces in a direction intersecting with the stacking direction, the metal frame contacting the cooler.

4. The reactor according to claim 1, further comprising:

a metal column that passes through the core inside of the coil in a coil axial direction, an end surface of the metal column contacting the cooler.

5. The reactor according to claim 1, further comprising: a magnetic shielding plate that is arranged between the coil and the cooler.

6. The reactor according to claim 1, wherein the core is made of hardened soft magnetic particles.

* * * * *